US005513578A

United States Patent [19]

Tordsen

[11] Patent Number: 5,513,578

[45] Date of Patent: May 7, 1996

[54] FOUR-SIDED DROP LEAF TABLE

[75] Inventor: Robert H. Tordsen, Oskaloosa, Iowa

[73] Assignee: Milton D. Tordsen, Oskaloosa, Iowa

[21] Appl. No.: 194,867

[22] Filed: Feb. 14, 1994

[51] Int. Cl.[6] ..... A47B 1/04

[52] U.S. Cl. ..... 108/77; 108/66; 108/144

[58] Field of Search ..... 108/66, 69, 77, 108/80, 144, 147, 150

[56] References Cited

U.S. PATENT DOCUMENTS

| | | | |
|---|---|---|---|
| 677,632 | 7/1901 | Brewer | 108/66 |
| 702,057 | 6/1902 | Hanson | 108/66 |
| 828,781 | 8/1906 | Smith | 108/144 |
| 1,490,261 | 4/1924 | Freeman | 108/66 |
| 1,781,602 | 11/1930 | Rygl | 108/66 |
| 1,792,673 | 2/1931 | Amstutz | 108/144 |
| 1,993,787 | 3/1935 | Howe | 108/66 |
| 1,997,239 | 4/1935 | Shea | 108/77 |
| 2,446,127 | 7/1948 | Cramer | 108/144 |
| 2,907,616 | 10/1959 | Sullivan | 108/66 |
| 3,741,514 | 6/1973 | Snurr | 108/144 |
| 3,887,155 | 6/1975 | Bertalot | 108/144 |
| 4,156,391 | 5/1979 | Ubezio | 108/144 |
| 4,183,689 | 1/1980 | Wirges et al. | 108/144 |
| 4,646,654 | 3/1987 | Sullivan | 108/66 |
| 4,693,442 | 9/1987 | Sills | 108/144 |
| 4,756,496 | 7/1988 | Hosan et al. | 108/144 |
| 5,243,921 | 9/1993 | Kruse et al. | 108/144 |

*Primary Examiner*—José V. Chen
*Assistant Examiner*—Rodney B. White
*Attorney, Agent, or Firm*—Zarley, McKee, Thomte, Voorhees, & Sease

[57] ABSTRACT

A four-sided drop leaf table is provided which can be converted between a square table and a round table, or between a elongated rectangular table and an oval table. The mating edges of the table and leaves have complementary routed contours. The corners of the leaves have a 45° miter cut edge which abuts a similar edge on an adjacent leaf when the leaves are in a raised position. The leaves also have a 45° compound cut edge extending from the bottom surface thereof, which allows the leaves to fold downwardly 90° from the raised position to a lowered position without interference. The table is provided with a telescoping pedestal so that the height of the table top can be adjusted between a coffee table height and dining table height.

9 Claims, 4 Drawing Sheets

FOUR-SIDED DROP LEAF TABLE

BACKGROUND OF THE INVENTION

Two-sided drop leaf tables have been known for many years. Three-sided drop leaf tables have also been known.

A conventional drop leaf table includes a central or main table top with opposing leaves on opposite sides of the table top. The leaves are hinged to the main portion so that they can be moved between a raised position, wherein the leaves are coplanar with the table top, and a lowered position, wherein the leaves extend substantially 90° downwardly from the respective edges of the table top. In the lowered position, the leaves reside below and substantially inwardly from the edges of the top, due to the inwardly spaced pivot axes of the connecting hinges.

A four-sided drop leaf table having a continuous perimeter edge has been commonly considered by wood workers and furniture craftsmen to be impossible to make, since the adjacent leaf corners would interfere with one another in the raised and/or lowered positions. Four-sided tables having a pivotal leaf on each side have been known. However, such tables are not a true drop leaf, since the pivot axes of the connecting hinges are located at the extreme edge of the main portion of the table, whereby the leaves reside below and outwardly from the edge of the main portion when in the lowered position. Also, such tables do not have a continuous perimeter edge.

Tables having different heights have also been known. For example, a dining table conventionally has a height of approximately 30 inches, while a coffee table has a conventional height of approximately 18-¾ inches. However, it has not been known before to provide a table having an adjustable height, so that a single table can function both as a low profile coffee table and a raised dining table.

Therefore, a primary objective of the present invention is the provision of a four-sided drop leaf table.

Another objective of the present invention is the provision of a four-sided drop leaf table which can be changed from a square shape to a round shape by raising the four leaves from a lowered position to a raised position.

Another objective of the present invention is the provision of a four-sided drop leaf table which can be changed from a rectangular shape to an oval shape by raising the four leaves from a lowered position to a raised position.

A further objective of the present invention is the provision of a table having an adjustable height.

Still another objective of the present invention is the provision of a table which can be raised and lowered to serve as a coffee table and a dining table.

A further objective of the present invention is the provision of a four-sided drop leaf table which is economical to manufacture and durable in use.

These and other objectives will become apparent from the following description of the invention.

SUMMARY OF THE INVENTION

The four-sided drop leaf table of the present invention includes a rectangular or square table top having four edges. A leaf is pivotally connected to each of the edges by a spring hinge, with the pivot axis of the hinge being spaced inwardly from the associated edge of the table top. The leaves are movable between a raised position coplanar with the table top and a lowered position extending 90° downwardly from the respective edges. The edges of the table top have a routed contour. The leaves have an inner edge having a routed contour complementary to the contoured edge of the table top. The leaves have an outer edge, which may also be routed. When all four leaves are in the raised position, the outer edge defines a continuous circular or oval edge for the table. Each leaf has opposite corners with a 45° miter cut extending from the inner edge toward the outer edge, and a 45° compound cut extending from the outer edge toward the inner edge adjacent the bottom surface of the leaf. When the leaves are in the raised position, the miter cut edges of adjacent leaves abut one another. When the leaves are in the lowered position, the compound cut edges of adjacent leaves abut, or nearly abut, one another.

The table top is mounted upon a telescoping pedestal having inner and outer portions which are vertically slidable with respect to one another so that the table top can be moved between raised and lowered positions. In the raised position, the table top is at a height sufficient to serve as a dining table. In the lowered position, the table top is at a height sufficient to serve as a coffee table. Locking means are provided on the pedestal to lock the inner and outer telescoping portions against relative movement, so that the table top is maintained at a selected height. A gas cylinder may be provided to aid in the raising of the table.

DETAILED DESCRIPTION OF THE DRAWINGS

Figure 1:
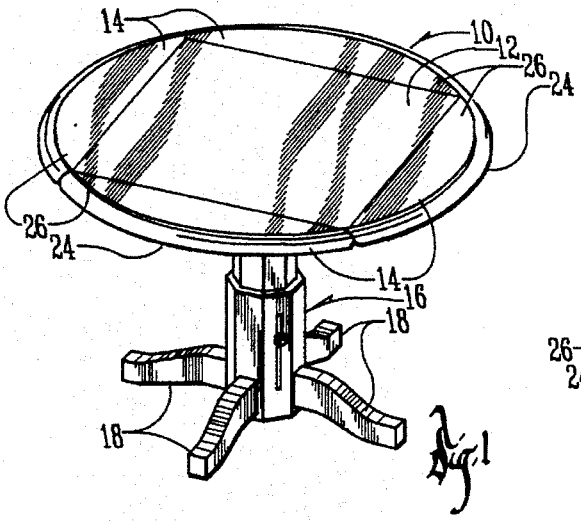
FIG. 1 is a perspective view of a four-sided drop leaf table according-to the present invention, with the leaves in a raised position.

In the drawings, the four-sided drop leaf table of the present invention is generally designated by the reference numeral 10. The table 10 includes a central or main portion or table top 12, four leaves 14 pivotally connected to the table top 12, a pedestal 16 for supporting the table top 12, and a plurality of legs 18 for stabilizing the table 10. It is understood that the four-sided drop leaf table of the present invention can be provided with conventional legs extending from the table top 12, as opposed to the pedestal 16.

Figure 2:
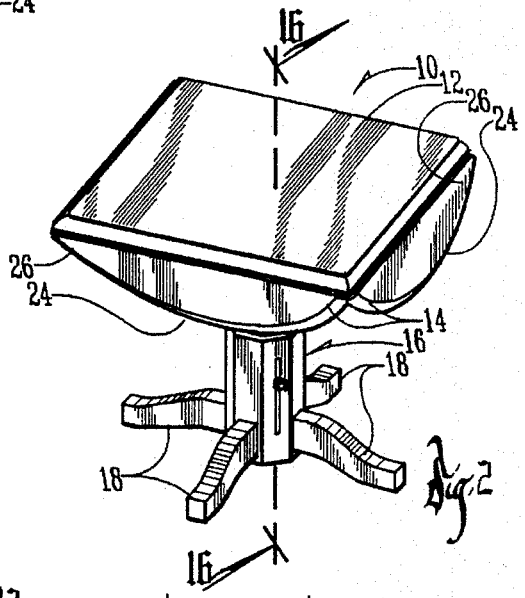
FIG. 2 is a perspective view similar to FIG. 1 showing the leaves in a lowered position.
Figure 3:
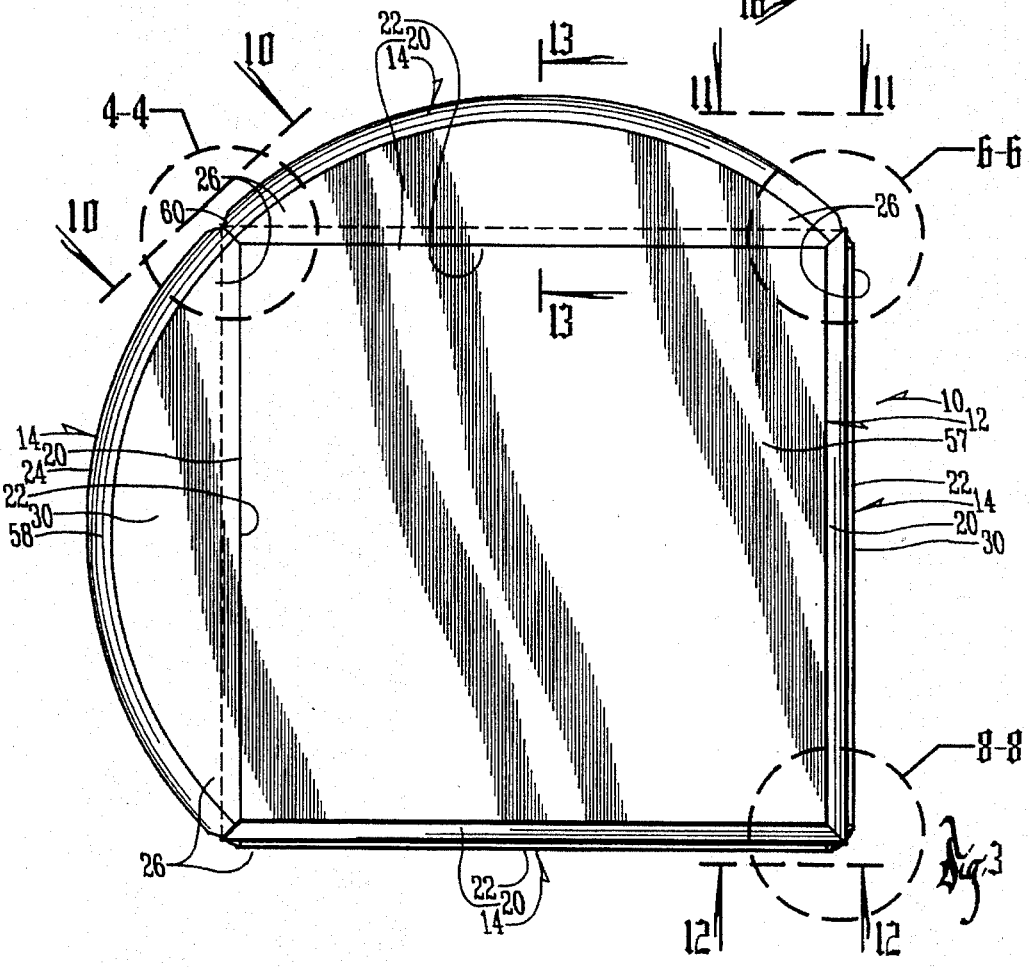
FIG. 3 is a top plan view of the four-sided drop leaf table of the present invention, with two leaves raised and two leaves lowered.
Figure 9:
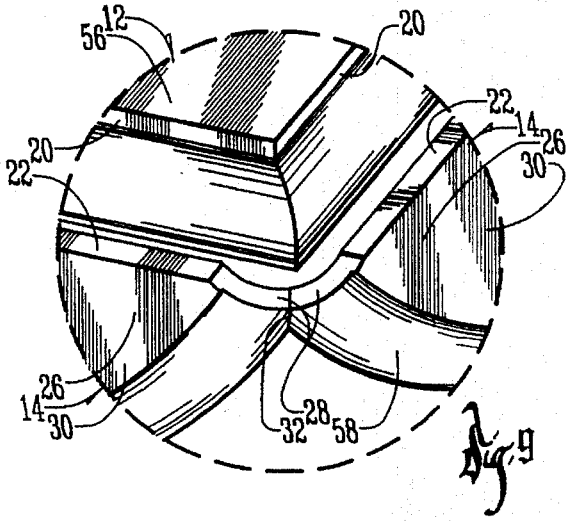
FIG. 9 is a perspective view of the corner shown in FIG. 8.
Figure 10:
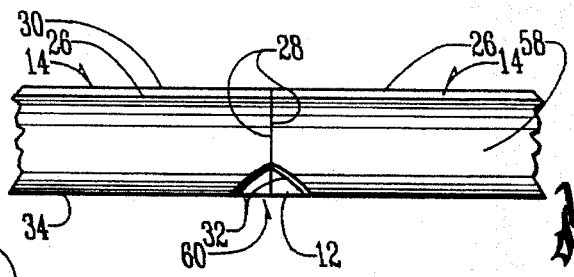
FIG. 10 is an elevation view taken along lines 10—10 of FIG. 3.
Figure 11:
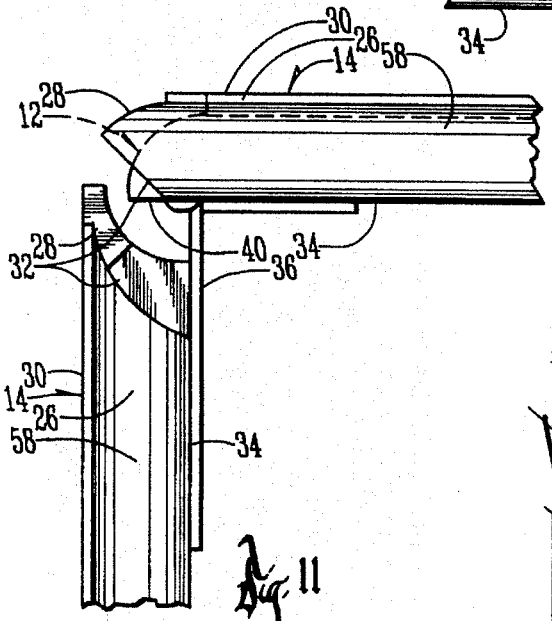
FIG. 11 is a side elevation view taken along lines 11—11 of FIG. 3.
Figure 12:
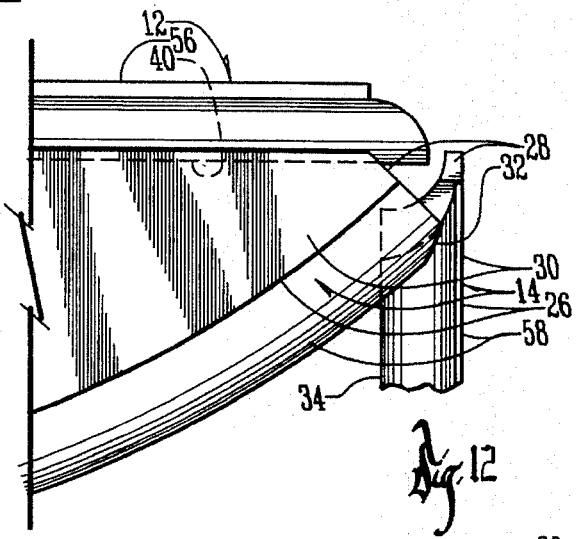
FIG. 12 is a side elevation view taken along lines 12—12 of FIG. 3.
Figure 14:
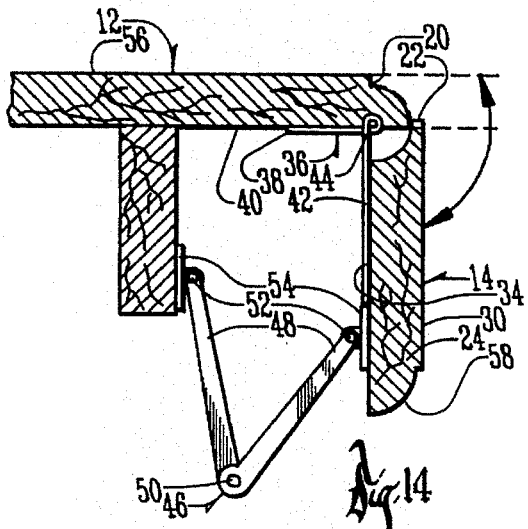
FIG. 14 is a view similar to FIG. 13 showing a leaf folded downwardly into the lowered position.

As seen in FIGS. 1 and 2, the table top 12 is square and has four sides or edges 20. Preferably, edges 20 have a routed contour, as best seen in FIG. 9, 12 and 14.

Figure 13:
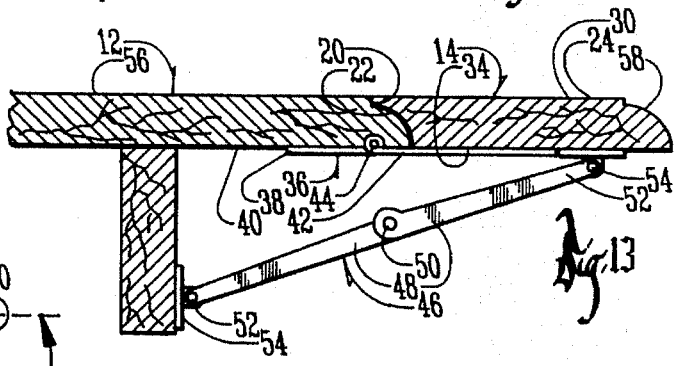
FIG. 13 is a sectional view taken along lines 13—13 of FIG. 3.

The four leaves 14 are identical to one another. Each leaf includes an inner edge 22, an outer edge 24, and opposite corners 26. Preferably, the inner edge 22 of each leaf has a routed contour or shape complementary to the contour of table top edges 20, as best seen in FIG. 13 and 14. The outer edge 24 of each leaf may also be routed so as to have a contour similar to the edges 20 of the table top 12, as seen in FIGS. 13 and 14.

Each corner 26 of each leaf 14 includes an edge 28 defined or made by a miter cut extending 45° from the inner edge 22. The edge 28 extends perpendicularly from the upper surface 30 of the leaf 14. Each leaf 14 also includes an edge 32 defined or created by a compound cut made at a 45° angle with respect to the bottom surface 34 of the leaf 14 and 45° with respect to the miter cut edge 28. The miter cut edge 28 and the compound cut edge 32 are planar, though in the drawings, the edges 28 and 32 appear to be curved due to the curvature and routed contour of the outer edge 24 of the leaf 14.

Each leaf 14 is pivotally connected to the table top 12 by one or more hinges 36. Preferably, the hinges 36 are conventional spring catch drop leaf hinges. As seen in FIGS. 13 and 14, each hinge 36 includes a first member 38 secured to the bottom surface 40 of the table top 12 by screws (not shown), and a second member 42 secured to the bottom surface 34 of the leaf 14 with screws (not shown). The pivot axis 44 of the hinge 36 is spaced inwardly approximately ½ inch from the edge 20 of the table top 12. Preferably, the pivot axis 44 is recessed into a slot (not shown) in the bottom surface 40 of the table top 12. Each hinge also includes a support brace 46, having a pair of pivotal arms 48 which are pivotally joined by a pin 50 at one end and pivotally connected by a pin 52 at the opposite end to a bracket 54 fastened to the bottom surface 34 of the leaf 14 by screws (not shown).

The hinges 36 allow the leaves 14 to be moved between a raised position, as shown in FIGS. 1 and 13, and a lowered position, as shown in FIGS. 2 and 14. In the raised position, the upper surfaces 30 of the leaves 14 are coplanar with the upper surface 56 of the table top 12. When the leaves are moved to the lowered position, the leaves hang downwardly substantially 90° from the table top 12 at a position partially inwardly from the edges 20 of the table top 12.

Figure 4:
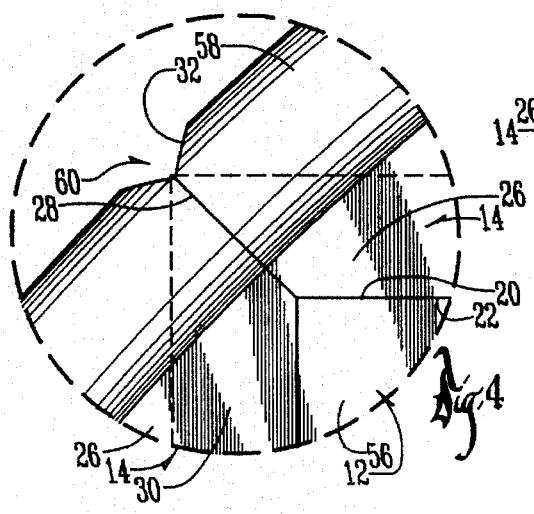
FIG. 4 is an enlarged top perspective view of a corner of the table taken along lines 4—4 of FIG. 3.
Figure 5:
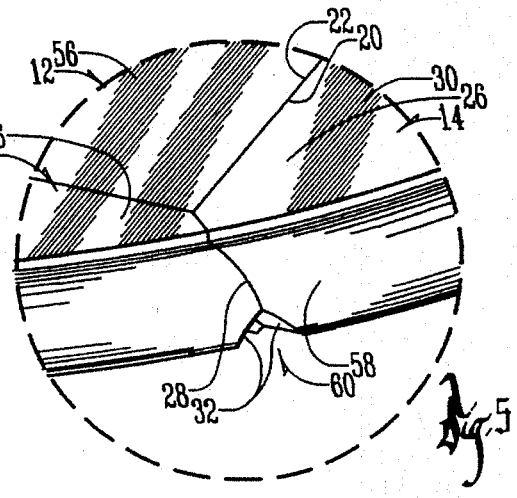
FIG. 5 is a perspective view showing the corner of FIG. 4.
Figure 6:
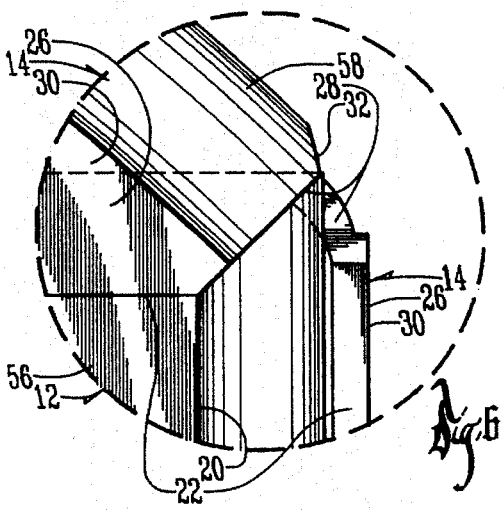
FIG. 6 is an enlarged top plan view of a corner taken along lines 6—6 of FIG. 3.
Figure 7:
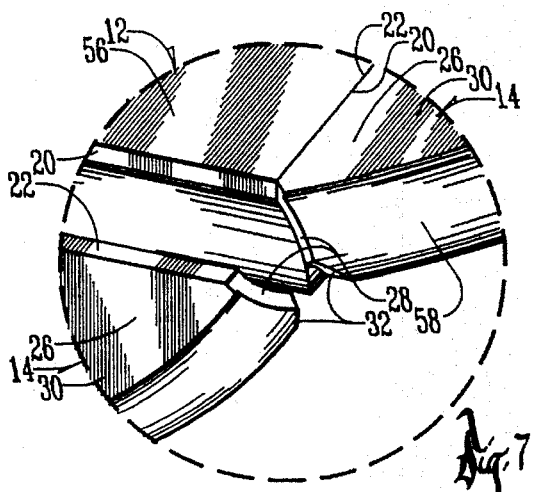
FIG. 7 is a perspective view showing the corner of FIG. 6.
Figure 8:
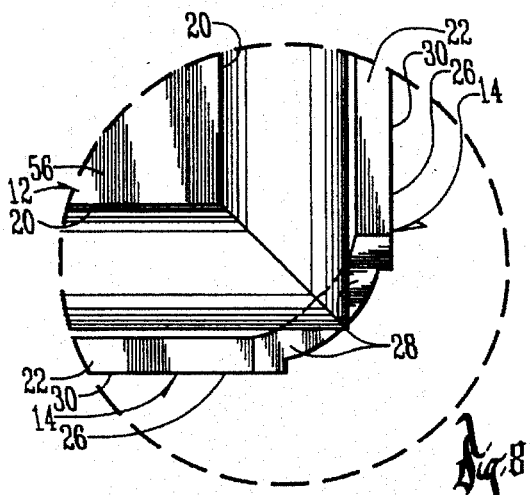
FIG. 8 is an enlarged top plan view of a corner taken along lines 8—8 of FIG. 3.

When the leaves are in the raised position, the complementary routed contours of the edges 20 of the table top 12 and of the inner edge 22 of the leaves 14 matingly engage, as seen in FIG. 13. Also, when the leaves are in the raised position, the miter cut edges 28 of adjacent leaves are closely spaced, or abut one another, as seen in FIG. 4. Also, when the leaves are in the raised position, the outer edge 24 defines a substantially continuous curved perimeter edge 58. Preferably, the perimeter edge 58 extends 360° adjacent the upper surface 30 of the leaves. A small notch 60 exists adjacent the bottom surface 34 of the leaves 14 when the leaves are in the raised position, as seen in FIGS. 4 and 5. When the leaves are in the lowered position, the compound cut edges 32 of the adjacent leaves are spaced closed, and may abut one another.

In constructing the table 10, the leaves 14 are initially rectangular in shape. The miter cut and compound cut, which form edges 32, 34 respectively at the leaf corners, are made in the preliminary rectangular leaves. The leaves with the corner cuts are then attached to the table top, after which the curved outer edges 24 are cut.

Thus, the four-sided drop leaf table 10 of the present invention can be converted from a table having a square surface, as shown in FIG. 2, to a table having a round surface, as seen in FIG. 1, and visa versa.

Figure 15:
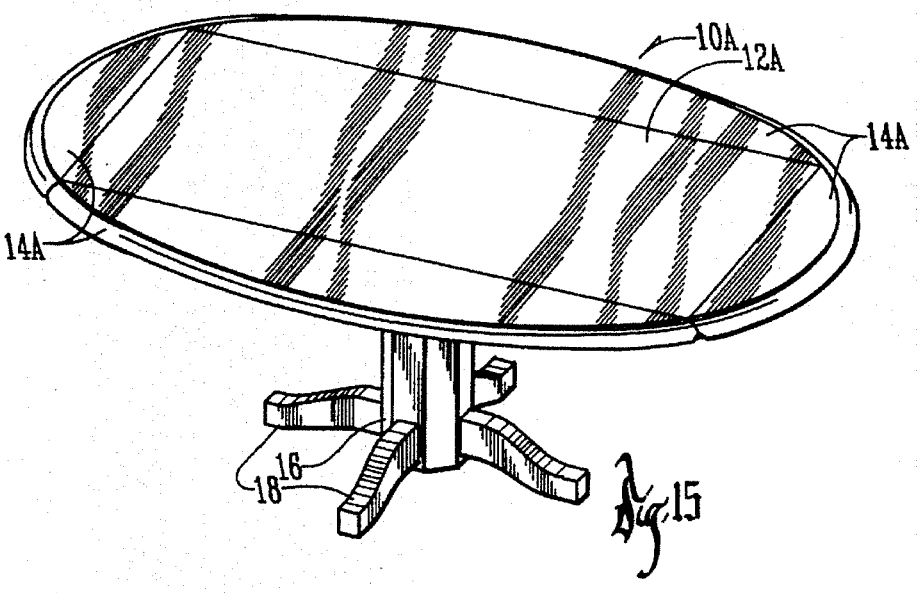
FIG. 15 is a perspective view of an alternative embodiment of a four-sided drop leaf table which can be changed from a rectangular shape to an oval shape.
Figure 16:
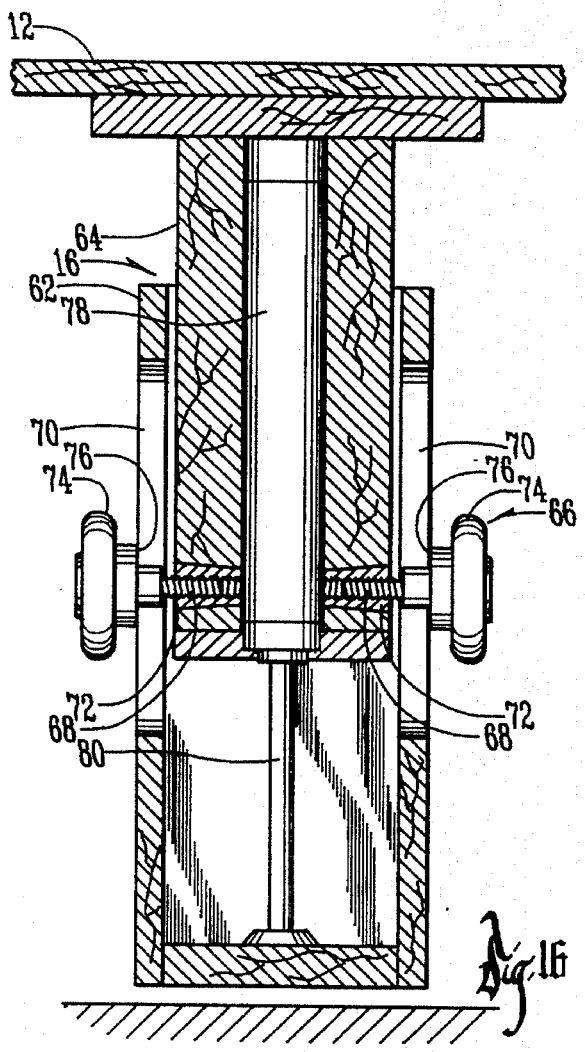
FIG. 16 is a sectional view taken along lines 16—16 of FIG. 2 showing the telescoping pedestal of the present invention.

In an alternative embodiment table **10*a*, as shown in FIG. 15, a rectangular table top 12*a* having major and minor axes is provided with leaves 14*a* along each edge. The table 10*a* can be converted from an elongated rectangular table to an oval table, and vice versa, by raising and lowering the leaves 14*a*, as described above with respect to the table 10**.

It is also desirable to make the height of the table 10 adjustable, such that the table can be moved from a coffee table height to a dining table height. The height adjustability is provided by the pedestal 16, which includes an outer member 62 and an inner member 64 telescopicly received within the outer member 62. The outer member 62 and inner member 64 are slideably movable with respect to one another such that the table top 12 can be moved between a coffee table height of approximately 18-¾ inches, and a dining table height of approximately 30 inches.

A locking mechanism 66 is provided for locking the outer and inner members 62, 64 against relative movement. More particularly, the locking means 66 includes a pair of threaded shafts 68 extending through respective verticle slots 70 on opposite sides of the outer member 62 of the pedestal 16. The shafts 68 are received within a threaded insert 72 fixed within the inner member 64 in alignment with the slots 70. Knobs 74 are provided on the exterior ends of the shafts 68, and have a surface 76 for engaging the outer member 64 on opposite sides of the slot 70.

When the knobs 74 are loosened, the inner member 62 can move vertically with respect to the outer member 64, as guided by the shafts 68 within the slots. When the knobs 74 and the shafts 68 are tightened, the outer member 62 frictionally engages the inner member 64 to prevent the table top 12 from being raised or lowered.

A gas cylinder 78 having an extendible and retractable arm 80 may be provided in the pedestal 16 so as to assist in the movement of the table top 12, particularly to the raised position. The gas cylinder 78 normally biases the table top 12 to the raised position, but the locking means 66 can be tightened to prevent extension of the inner member 64 relative to the outer member 62.

Preferably, slots 70 are 12 inches long, with each inner and outer member being 16 inches long. Thus, the table top can be raised or lowered approximately 12 inches, corresponding to the length of the slot 70. Also, as shown in FIG. 1, the pedestal is octagon shape. Preferably, with such an eight-sided pedestal, a locking mechanism 66 is provided on four opposing sides. The pedestal 16 may also be constructed so as to be six-sided, wherein preferably three equally spaced locking mechanisms 66 are provided. Also, as shown in the drawings, the legs 18 are spaced laterally from the slots 70, so that there is no interference between the legs 18 and the locking mechanism 66 when the table is moved to the lower-most position. Thus, on a eight-sided pedestal, four legs are provided, while only three legs are provided on a six-sided pedestal.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A four-sided drop leaf table, comprising:

a rectangular table having a first edge, a second edge, a third edge, and a forth edge, with adjacent edges defining four 90° corners of the table;

a first leaf pivotally attached to the table top adjacent the first edge, and having an inner edge and a curved outer edge;

a second leaf pivotally attached to the table top adjacent the second edge, and having an inner edge and a curved outer edge;

a third leaf pivotally attached to the table top adjacent the third edge, and having an inner edge and a curved outer edge;

a fourth leaf pivotally attached to the table top adjacent the fourth edge, and having an inner edge and a curved outer edge;

each leaf having opposite corner portions with an angled segment extending between the inner and outer edges at each corner portion;

hinges pivotally connecting each leaf and respective table top edge whereby each leaf is pivotal between a raised position substantially coplanar with the table top and a lowered position extending downwardly substantially 90° from the table top the angled segment of each leaf mating with the angled segment of each adjacent leaf to define a substantially continuous perimeter edge when all four leaves are in the raised positions.

2. The table of claim 1 wherein each leaf has an upper surface and a lower surface, each angled segment including a 45° miter cut edge extending outwardly from the inner edge and perpendicularly to the upper surface, and a 45° compound cut edge extending inwardly from the outer edge and outwardly from the lower surface, such that the miter cut edges of adjacent leaves abut one another when the leaves are in the raised positions and the compound cut edges of adjacent leaves are spaced closely to one another when the leaves are in lower positions.

3. The table of claim 1 wherein each of the four edges of the table top has a routed contour and the inner edge of each leaf has a routed contour complimentary to the contour of the adjacent edge of the table top.

4. The table of claim 1 wherein each hinge includes a pivot spaced inwardly from the edge of the table top.

5. The table of claim 1 wherein the table top is square and the perimeter edge of the leaves in the raised positions is circular.

6. The table of claim 1 wherein the table top has major and minor axis, and the perimeter edge of the leaves in the raised positions is oval.

7. The table of claim 1 wherein the edges of the table top are routed, the inner edges of the leaves are routed in a shape complimentary to the table top edges, and the outer edges of the leaves are routed.

8. The table of claim 7 wherein the four leaves define an enlarged table surface having a substantially continuous curved and routed perimeter edge when all four leaves are in the raised position.

9. The table of claim 1 wherein the leaves reside substantially beneath the table top when in the lowered position.

* * * * *